US010040163B2

(12) United States Patent
Eo et al.

(10) Patent No.: US 10,040,163 B2
(45) Date of Patent: Aug. 7, 2018

(54) POLISHING APPARATUS

(71) Applicant: Samsung Display Co., Ltd., Yongin-si, Gyeonggi-do (KR)

(72) Inventors: Sungwoo Eo, Suwon-si (KR); Hyunchul Jung, Cheonan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 57 days.

(21) Appl. No.: 15/166,163

(22) Filed: May 26, 2016

(65) Prior Publication Data

US 2017/0057047 A1 Mar. 2, 2017

(30) Foreign Application Priority Data

Aug. 31, 2015 (KR) ..... 10-2015-0123039

(51) Int. Cl.
*B24B 29/04* (2006.01)

(52) U.S. Cl.
CPC ..... *B24B 29/04* (2013.01)

(58) Field of Classification Search
CPC ..... B24B 29/04
USPC ..... 451/42, 41, 246, 51
See application file for complete search history.

(56) References Cited

U.S. PATENT DOCUMENTS 1,426,147 A * 8/1922 Bugbee ..... G02C 7/02 351/159.52
2,405,417 A * 8/1946 Fruth ..... B24B 7/162 451/307
3,020,684 A * 2/1962 Oldfield ..... B24B 13/005 451/388
3,978,620 A * 9/1976 Feneberg ..... B24B 9/142 451/256

FOREIGN PATENT DOCUMENTS

| | | | |
|---|---|---|---|
| JP | 4662018 | B2 | 1/2011 |
| KR | 1988-0013656 | B1 | 12/1988 |
| KR | 1998-0013656 | B1 | 12/1988 |
| KR | 10-2011-0134207 | | 12/2011 |
| KR | 10-2015-0002176 | | 1/2015 |

* cited by examiner

*Primary Examiner* — Robert Rose
(74) *Attorney, Agent, or Firm* — Lewis Roca Rothgerber Christie LLP

(57) ABSTRACT

A polishing apparatus includes a jig unit including a substrate supporting part having a placing surface on which a substrate having a first curvature is placed. The placing surface has a second curvature corresponding to the first curvature and a polishing unit includes at least one polishing part to be rotated to polish a process surface of the substrate. The process surface of the curved substrate may be uniformly polished and foreign substances generated during the polishing process are prevented from entering into the substrate.

19 Claims, 12 Drawing Sheets

POLISHING APPARATUS

CROSS-REFERENCE TO RELATED APPLICATION

This application claims priority to and the benefit of Korean Patent Application No. 10-2015-0123039, filed on Aug. 31, 2015, the entire content of which is incorporated herein by reference.

BACKGROUND

1. Field

Aspects of embodiments of the present disclosure relate to a polishing apparatus.

2. Description of the Related Art

In general, a substrate used as a window substrate of a display device is made of a tempered glass or a plastic. The substrate is required to have a uniform surface flatness for desired optical properties (i.e., design and transparency of the substrate).

In recent years, as demand for curved display devices increases, there is a need for uniformly processing a surface of a curved substrate. However, conventional polishing apparatuses apply a pressure to the substrate in a direction substantially perpendicular to the substrate, and as a result, the curved surface of the substrate is not uniformly polished.

SUMMARY

Aspects of example embodiments of the present disclosure provide a polishing apparatus capable of polishing a curved substrate having a curvature (e.g., a predetermined curvature).

Embodiments of the inventive concept provide a polishing apparatus including a jig unit including a substrate supporting part having a placing surface on which a substrate having a first curvature is placed. The placing surface has a second curvature corresponding to the first curvature and a polishing unit includes at least one polishing part to be rotated to polish a process surface of the substrate.

The first curvature may be substantially equal to the second curvature.

The jig unit may further include a rotating table on which the substrate supporting part is placed and a jig driving part rotating the rotating table.

The polishing unit may further include a polishing driving part to rotate the polishing part.

The polishing unit may further include a rotating plate above the polishing part to hold the polishing part and a coupling member connecting the polishing part and the rotating plate.

The coupling member may serve as a rotating axis to rotate the polishing part.

The coupling member may be disposed substantially parallel to the process surface.

The substrate supporting part may include a plurality of vacuum suction inlets to hold the substrate.

The substrate supporting part may have a substantially cylindrical shape having a radius corresponding to the second curvature and an empty space defined therein.

The substrate supporting part may have a substantially cylindrical shape having a radius corresponding to the second curvature and the radius may be greater than a height of the cylindrical shape.

The substrate supporting part may be rotated in a first direction and the polishing part may be rotated in a direction opposite to the first direction.

The polishing apparatus may further include a driving part to rotate the jig unit. The substrate supporting part may include a plurality of recesses formed in one of an inner circumferential surface and an outer circumferential surface of the substrate supporting part and arranged on at regular intervals. The driving part may include a driving gear comprising a plurality of protrusions respectively inserted into the recesses.

A plurality of substrate supporting parts maybe provided stacked on one another.

The polishing part may include a body having a cylindrical shape and a polishing layer on an outer circumferential surface of the body.

The polishing layer may be a polishing sheet, a polishing pad, a brush, or a sponge.

The polishing part may include a first sub-polishing part having a substantially cylindrical shape and at a center portion of the polishing part and a second sub-polishing part extending from the first sub-polishing part and including a stepped portion. The second sub-polishing part may have a circumference greater than a circumference of the first sub-polishing part.

The second sub-polishing part may be adjacent an upper portion and/or a lower portion of the first sub-polishing part.

The polishing layer may include a first polishing layer in the first sub-polishing part and a second polishing layer in the second sub-polishing part. The first and second polishing layers may have different surface roughnesses.

According to the above, a polishing apparatus includes a substrate supporting part having a placing surface on which a substrate having a first curvature is placed and the placing surface has a second curvature corresponding to the first curvature. Therefore, the curved surface of the substrate may be uniformly polished. In addition, since the substrate processed is parallel to the polishing part, foreign substances may be prevented from entering into the substrate during the polishing process.

BRIEF DESCRIPTION OF THE DRAWINGS

The above and other advantages of the present disclosure will become readily apparent by reference to the following detailed description when considered in conjunction with the accompanying drawings wherein.

DETAILED DESCRIPTION

Figure 1:
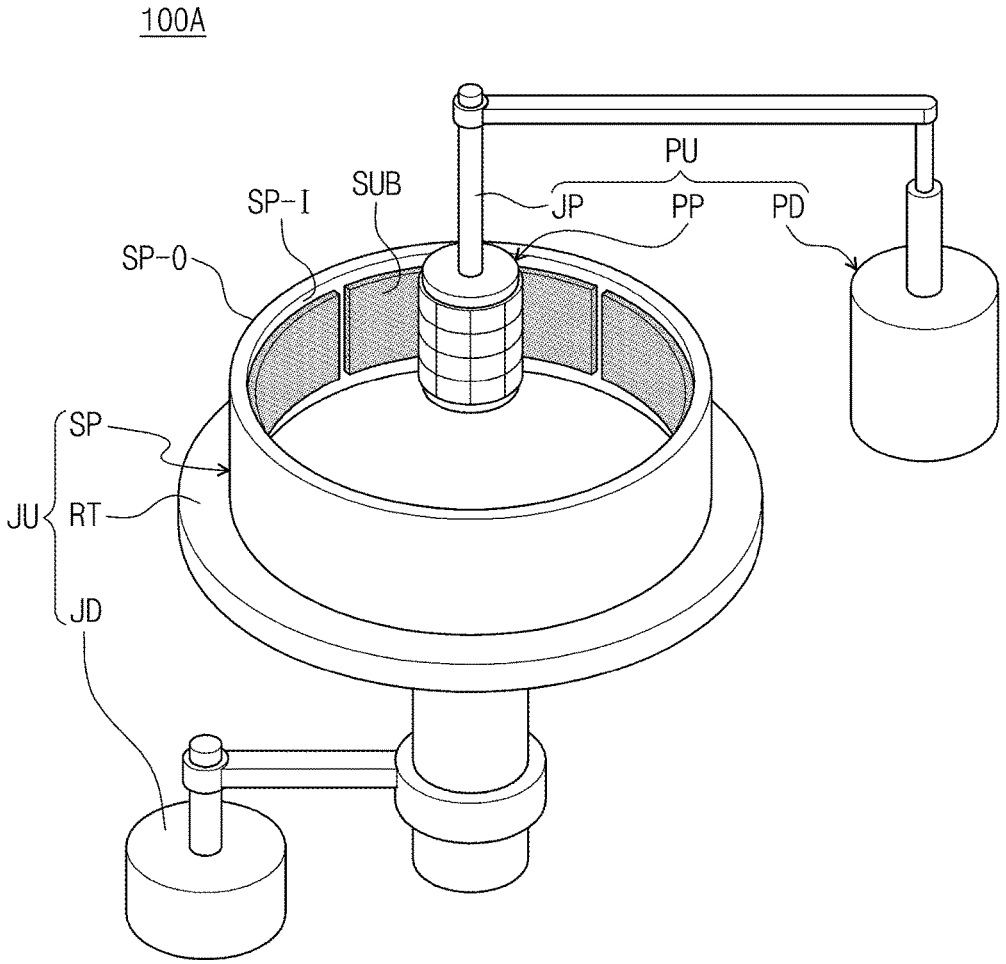
FIG. 1 is a perspective view showing a polishing apparatus according to some exemplary embodiments of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure.

In the drawings, the thickness of layers, films, and regions may be exaggerated for clarity. Like numerals refer to like elements throughout. It will be understood that when an element such as a layer, film, region, or substrate is referred to as being "on" another element, it can be directly on the other element or intervening elements may also be present. Like numbers refer to like elements throughout. It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. As used herein, the term "and/or" includes any and all combinations of one or more of the associated listed items. In addition, even though a surface of any layer is shown to be flat, a step difference occurs on an upper layer in accordance with a surface shape of a lower layer.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

As used herein, the terms "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Hereinafter, some exemplary embodiments of the present invention will be explained in detail with reference to the accompanying drawings.

FIG. 1 is a perspective view showing a polishing apparatus 100A according to some exemplary embodiments of the present disclosure. The polishing apparatus 100A includes a jig unit JU and a polishing unit PU. The jig unit JU may include a substrate supporting part SP having a placing surface on which a substrate SUB to be polished by the polishing apparatus 100A may be placed (e.g., affixed or attached).

A substrate SUB processed by the polishing apparatus 100A may be, but is not limited to, a glass or plastic substrate. In addition, the substrate SUB may include an acrylic resin or a tempered glass, which may be used to form a window substrate of a display device (e.g., a substrate including a transparent material that may transmit light). It should be appreciated that the substrate SUB to be polished is not limited thereto or thereby.

The substrate SUB may be a curved substrate having a predetermined curvature. In some embodiments, for instance, the substrate SUB is curved in one direction to have a single curvature (e.g., a single convex shaped curvature or a single concave shaped curvature). The polishing apparatus 100A may be used to polish a front surface or a rear surface of the substrate SUB. In embodiments with a substrate SUB having a single curvature, the front surface of the substrate SUB may have a convex curved surface and the rear surface of the substrate SUB may have an opposite surface to the convex curved surface (e.g., a complimentary convex shape). The polishing apparatus 100A according to the present exemplary embodiment may process at least one of the front and rear surfaces of the substrate SUB.

In some embodiments, the substrate supporting part SP includes a placing surface having a curvature corresponding to the curvature of the curved substrate SUB. The placing surface, to which the substrate SUB is fixed, may be an inner circumferential surface SP-I of the supporting part SP or an outer circumferential surface SP-O of the supporting part SP.

The inner circumferential surface SP-I or the outer circumferential surface SP-O of the substrate supporting part SP, on which the substrate SUB is placed, may be a curved surface having a curvature corresponding to the curvature of the substrate SUB. For instance, in embodiments where the curved substrate SUB has a first curvature and the placing surface of the substrate supporting part SP has a second curvature, the first curvature may be substantially the same as the second curvature. In addition, in embodiments where the placing surface on which the substrate SUB is placed is the inner circumferential surface SP-I of the substrate supporting part SP, the curvature of the substrate SUB may be substantially the same as the curvature of the inner circumferential surface SP-I of the substrate supporting part SP. In embodiments where the placing surface on which the substrate SUB is placed is the outer circumferential surface SP-O of the substrate supporting part SP, the curvature of the substrate SUB may be substantially the same as the curvature of the outer circumferential surface SP-O of the substrate supporting part SP. Where the substrate supporting part SP is shaped such that the curvature of the substrate SUB corresponds to the curvature of the substrate supporting part SP, the polishing unit PU may uniformly polish the surface of the substrate SUB, and thus polishing quality may be improved.

The substrate supporting part SP may have a hollow cylindrical shape. For instance, in some embodiments, the substrate supporting part SP has a substantially ring shaped cross-section in a direction perpendicular to a height direction of the substrate supporting part SP (e.g., in a horizontal cross-section of a substantially vertical height direction). In this embodiment, the placing surface on which the curved substrate SUB is fixed corresponds to the inner circumferential surface SP-I of the cylindrical shape.

In embodiments where the placing surface on which the substrate SUB is placed is the inner circumferential surface SP-I, the outer circumferential surface SP-O of the substrate supporting part SP, on which the substrate SUB is not placed, may have a non-circular cross-sectional shape in a direction perpendicular to a height direction of the substrate supporting part SP. That is, the inner circumferential surface SP-I of the substrate supporting part SP, on which the substrate SUB is placed, may have a circular cross-sectional shape, and the outer circumferential surface SP-O of the substrate supporting part SP may have a cross-section with a curved shape or a polygonal shape, which is different from the circular cross-sectional shape of the inner circumferential surface SP-I.

The substrate supporting part SP may be formed of a metal material to prevent the substrate supporting part SP from being damaged during the polishing process. For instance, the substrate supporting part SP may include stainless steel (SUS).

The jig unit JU may further include a jig driving part JD to apply power (e.g., by rotation) to a rotating table RT. The jig driving part JD may be connected to a rotating axis of the rotating table RT and the rotating table RT may be rotated by the power applied thereto through the rotating axis, thereby rotating the substrate supporting part in a clockwise direction or a counter-clockwise direction.

The polishing unit PU may include a polishing part PP to polish the surface of the substrate SUB. In addition, the polishing unit PU may further include a polishing driving part PD to rotate the polishing part PP. FIG. 1 shows a single polishing part PP, but the number of the polishing parts PP is not limited to one. That is, the polishing unit PU may include a plurality of polishing parts PP.

FIG. 1 shows the jig driving part JD and the polishing driving part PD according to some embodiments, but one of the jig driving part JD and the polishing driving part PD may be omitted in some embodiments. For instance, in some embodiments, only the polishing part PP is rotated to process the substrate SUB, while the rotating table RT on which the substrate supporting part SP is arranged is not rotated. In this embodiment, the polishing apparatus 100A includes a polishing driving part PD that selectively drives the polishing part PP and the jig driving part JD may be omitted. In some embodiments where the rotating table RT on which the substrate supporting part SP is placed is rotated while the polishing part PP is not rotated, the polishing apparatus 100A may include the jig driving part JD and the polishing driving part PD may be omitted.

In addition, in embodiments where the polishing apparatus 100A includes the jig driving part JD and the polishing driving part PD, only one driving part of the jig driving part JD and the polishing driving part PD may be required to be operated to provide power to polish the substrate SUB. In embodiments where both the jig driving part JD and the polishing driving part PD are operated, the polishing process with respect to the substrate SUB may be improved.

In FIG. 1, only one substrate supporting part SP is on the rotating table RT, but the number of the substrate supporting parts SP is not limited to one. That is, a plurality of substrate supporting parts SP may be on the rotating table RT. In addition, the substrate supporting parts SP may be arranged spaced apart from each other on the rotating table RT, and a plurality of polishing parts PP may be provided that respectively correspond to the substrate supporting parts SP.

Figure 2:
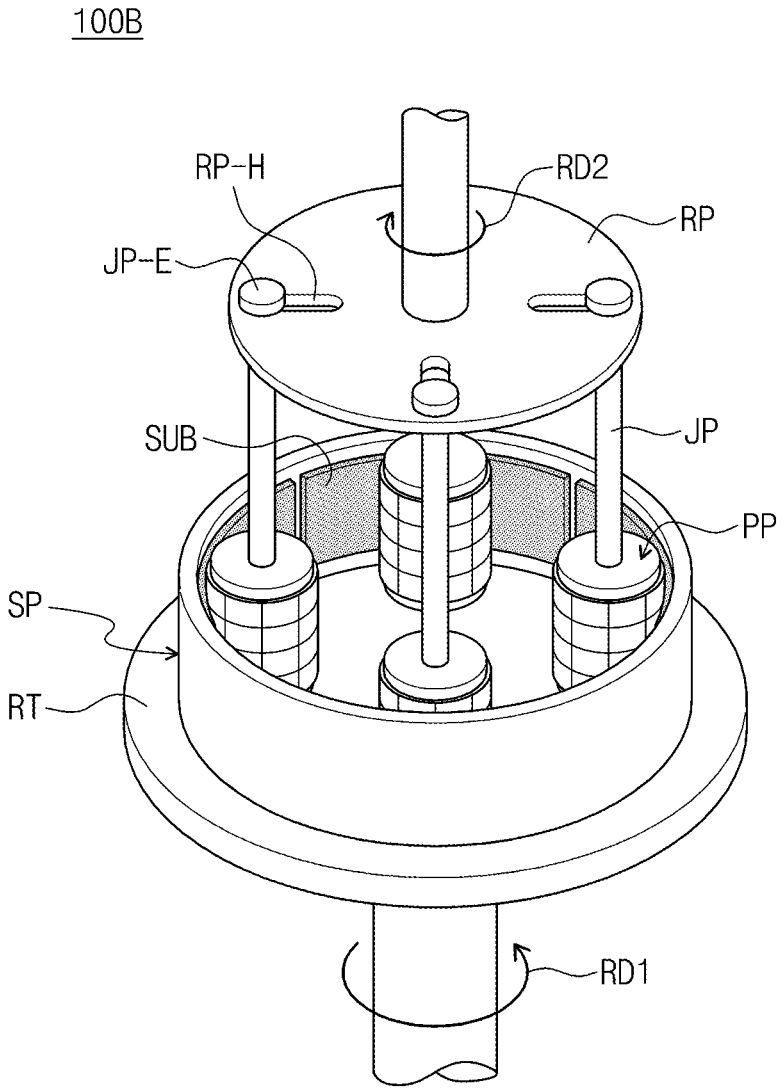
FIG. 2 is a perspective view showing a polishing apparatus according to some exemplary embodiments of the present disclosure.
Figure 3:
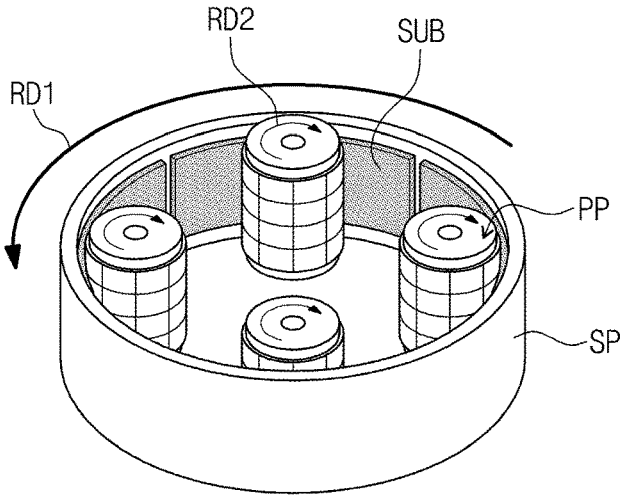
FIG. 3 is a perspective view showing a substrate supporting part and a polishing part of the polishing apparatus shown in FIG. 2.

FIG. 2 is a perspective view showing a polishing apparatus 100B according to some exemplary embodiments of the present disclosure and FIG. 3 is a perspective view showing a polishing unit PU including a substrate supporting part SP and a polishing part PP of the polishing apparatus 100B shown in FIG. 2.

Referring to FIG. 2, the polishing apparatus 100B includes a jig unit JU and a polishing unit PU. The jig unit JU includes a rotating table RT, a substrate supporting part SP on the rotating table RT, and a jig driving part JD (not shown) driving the rotating table RT.

The polishing unit PU according to the embodiment in FIG. 2 includes at least one polishing part PP and a rotating plate RP affixing the polishing part PP. In addition, a coupling member JP is between the polishing part PP and the rotating plate RP to connect the polishing part PP and the rotating plate RP. Further, the polishing unit may further include a polishing driving part PD (not shown) to drive the rotating plate RP. A fixing part JP-E is located at one end of the coupling member JP and the fixing part JP-E is on the rotating plate RP to affix the polishing part PP.

The coupling part JP connected to the polishing part PP may be located at a center portion of an upper surface of the polishing part PP. The coupling part JP is affixed to the polishing part PP and serves as a rotating axis to rotate the polishing part PP. In addition, the fixing part JP-E located at one end of the coupling member JP (e.g., the top end) may be inserted into a hole RP-H formed through the rotating plate RP and affixed to the rotating plate RP.

Since the polishing part PP is affixed by the fixing part JP-E, there may be a set distance (e.g., a gap) between the polishing part PP and the surface of the substrate SUB to be polished (the "process surface" of the substrate SUB). For instance, in embodiments where the polishing part PP is closer to the process surface of the substrate SUB, a pressure may be applied to the process surface of the substrate SUB.

The polishing part PP is substantially parallel to the substrate SUB in the embodiment depicted in polishing apparatus 100B. The coupling member JP, which serves as the rotating axis of the polishing part PP, is also substantially parallel to the process surface of the substrate SUB. Accordingly, the polishing part PP may be uniformly provided to the process surface of the substrate SUB regardless of the position at which the substrate SUB is located on the substrate supporting part SP, and thus the polishing quality may become uniform throughout the substrate SUB. In addition, the polishing part PP may be provided to the entire surface of the substrate SUB along the curved surface of the process surface of the substrate SUB. In embodiments where the process surface of the substrate SUB is substantially parallel to the coupling member JP serving as the rotating axis, polishing residue generated during the substrate polishing process may be discharged downward and removed from the process surface of the substrate SUB. Therefore, defects in quality caused by the polishing process may be prevented from occurring.

According to FIGS. 1 to 3, one of the jig unit JU and polishing unit PU of the polishing apparatuses 100A and 100B may be fixed and the other unit may be rotated to achieve a desired polishing degree of the substrate SUB. In addition, the jig unit JU may be rotated in a first direction RD1 (i.e., clockwise or counter-clockwise) and the polishing unit PU may be rotated in an opposite direction RD2 to the first direction RD1. For instance, the jig unit JU may be rotated in a counter-clockwise direction and the polishing unit PU may be rotated in a clockwise direction, and vice versa. Further, the polishing unit PU and the jig unit JU may be rotated at different speeds.

Figure 4:
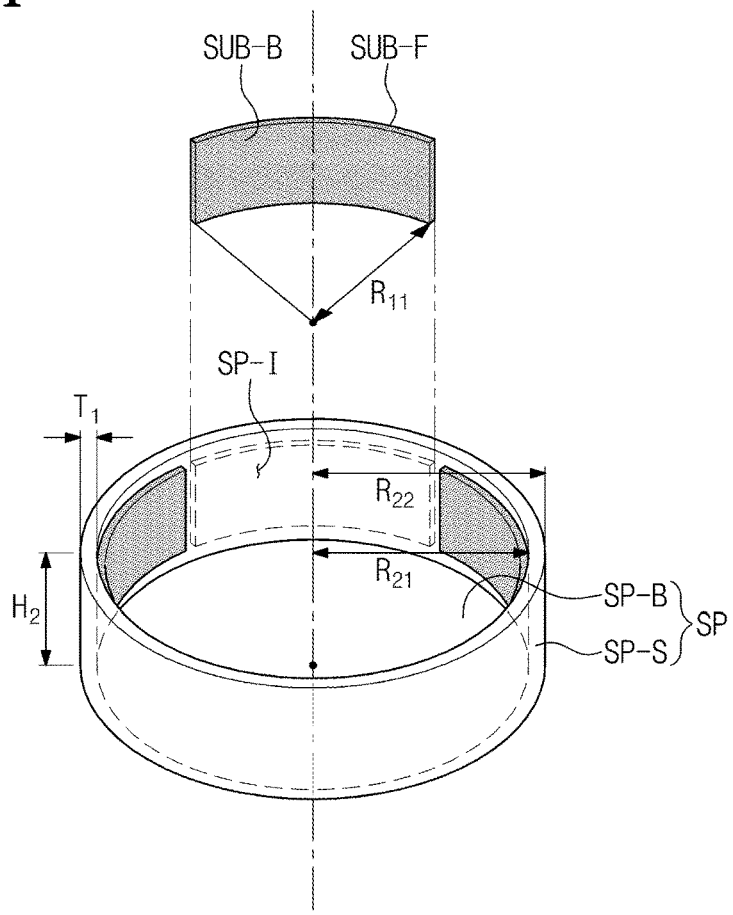
FIG. 4 is a perspective view showing an arrangement of the substrate supporting part and a substrate of the polishing apparatus shown in FIG. 2.

FIG. 4 is a perspective view showing an arrangement of the substrate supporting part SP and the substrate SUB of the polishing apparatus shown in FIG. 2. Referring to FIG. 4, the substrate supporting part SP may include a bottom surface SP-B and a side surface SP-S and may have a substantially hollow cylindrical shape. In addition, the substrate supporting part SP may have a constant thickness $T_1$. The bottom surface SP-B may be omitted in some embodiments.

In addition, the substrate supporting part SP may have a circular cross sectional shape with a distance to the inner circumferential surface SP-I having a radius $R_{21}$ and a distance to the outer circumferential surface SP-O having a radius $R_{22}$. A height $H_2$ of the cylindrical shape of the substrate supporting part SP may be longer than a length of radii $R_{21}$ and $R_{22}$ of the substrate supporting part SP.

As shown in FIG. 4, in embodiments where the substrate is placed on the inner circumferential surface SP-I of the substrate supporting part SP, the radius $R_{21}$ of the inner circumferential surface SP-I may be substantially equal to a radius $R_{11}$ of the substrate SUB. In embodiments where the substrate is placed on the outer circumferential surface SP-O of the substrate supporting part SP, the radius $R_{22}$ of the outer circumferential surface SP-O may be substantially equal to the radius $R_{11}$ of the substrate SUB.

The substrate supporting part SP may have radii $R_{21}$ and/or $R_{22}$ greater than the height $H_2$ of the substrate supporting part SP. In such embodiments, a plurality of substrates SUB may be arranged on the inner circumferential surface SP-I or the outer circumferential surface SP-O of the substrate supporting part SP.

Figure 5:
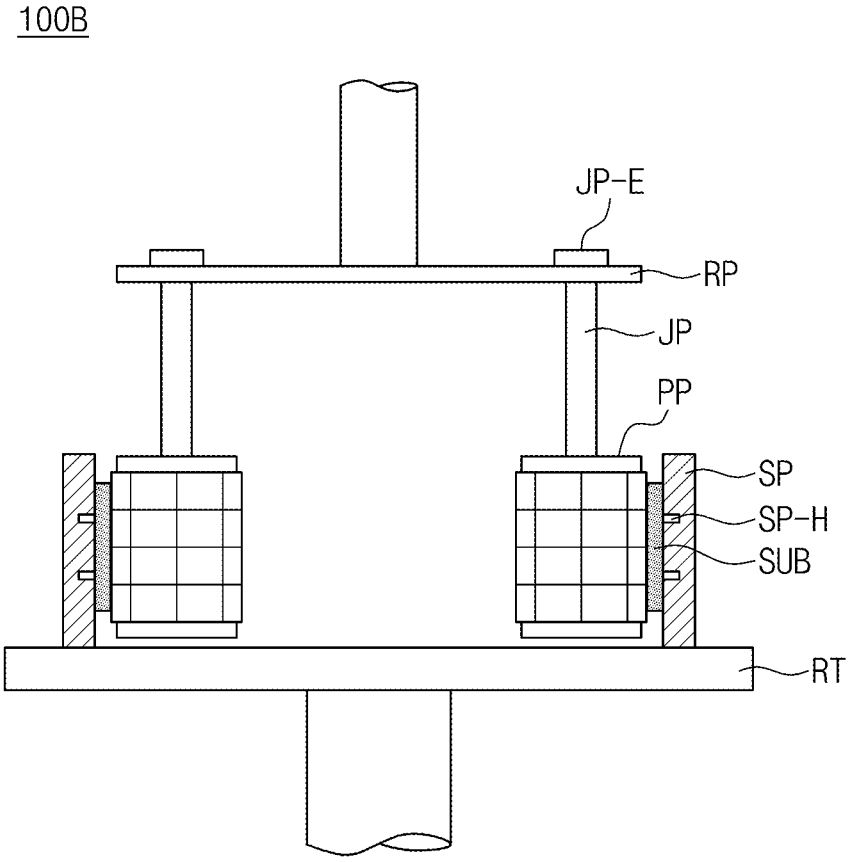
FIG. 5 is a cross-sectional view of the polishing apparatus shown in FIG. 2.
Figure 6:
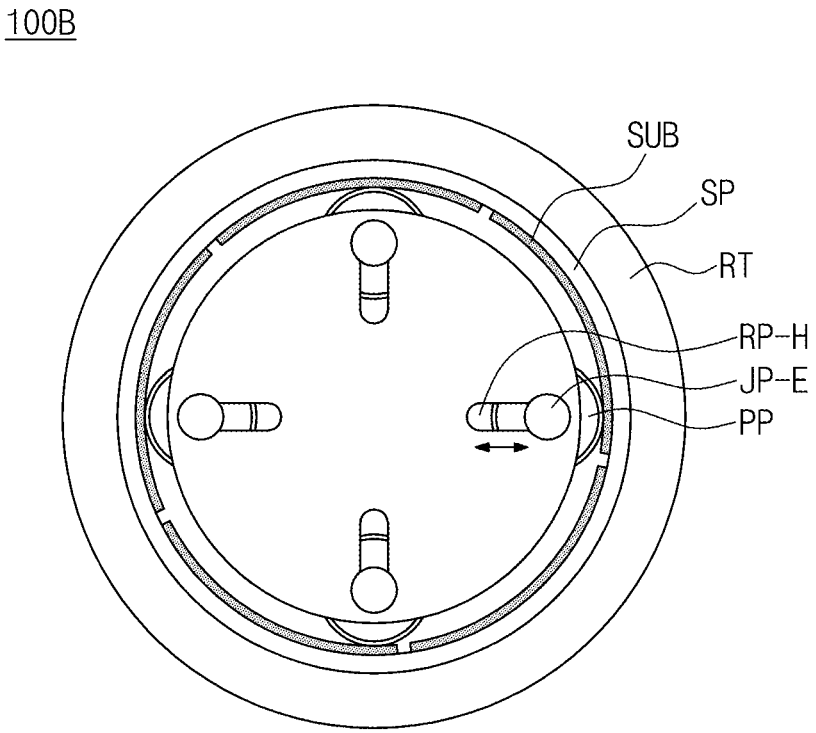
FIG. 6 is a plan view of the polishing apparatus shown in FIG. 2.

FIG. 5 is a cross-sectional view of the polishing apparatus 100B shown in FIG. 2 and FIG. 6 is a plan view of the polishing apparatus 100B shown in FIG. 2.

Referring to FIGS. 5 and 6, the substrate supporting part SP of the polishing apparatus 100B may include a plurality of vacuum suction inlets SP-H. For instance, the substrate SUB may be affixed using a vacuum, which is generated by sucking air through the vacuum suction inlets SP-H.

In addition, the polishing part PP may be connected to the rotating plate RP by the coupling member JP. The fixing part JP-E located at one end portion of the coupling member JP is on the rotating plate RP to affix the polishing part PP to the rotating plate RP. The fixing part JP-E may be moved in a coupling hole RP-H formed through the rotating plate RP (e.g., to reposition the polishing part PP relative to the substrate SUB). For instance, the position of the fixing part JP-E affixed to the coupling hole RP-H may be determined based on a size of the polishing part PP (e.g., a diameter of the polishing part PP).

Hereafter, polishing apparatuses according to some exemplary embodiments will be described in detail with reference to FIGS. 7 to 10. Parts and portions that are identical or similar to parts and portions of the previous embodiments will be described with the same reference numerals and the description thereof is not repeated.

Figure 7:
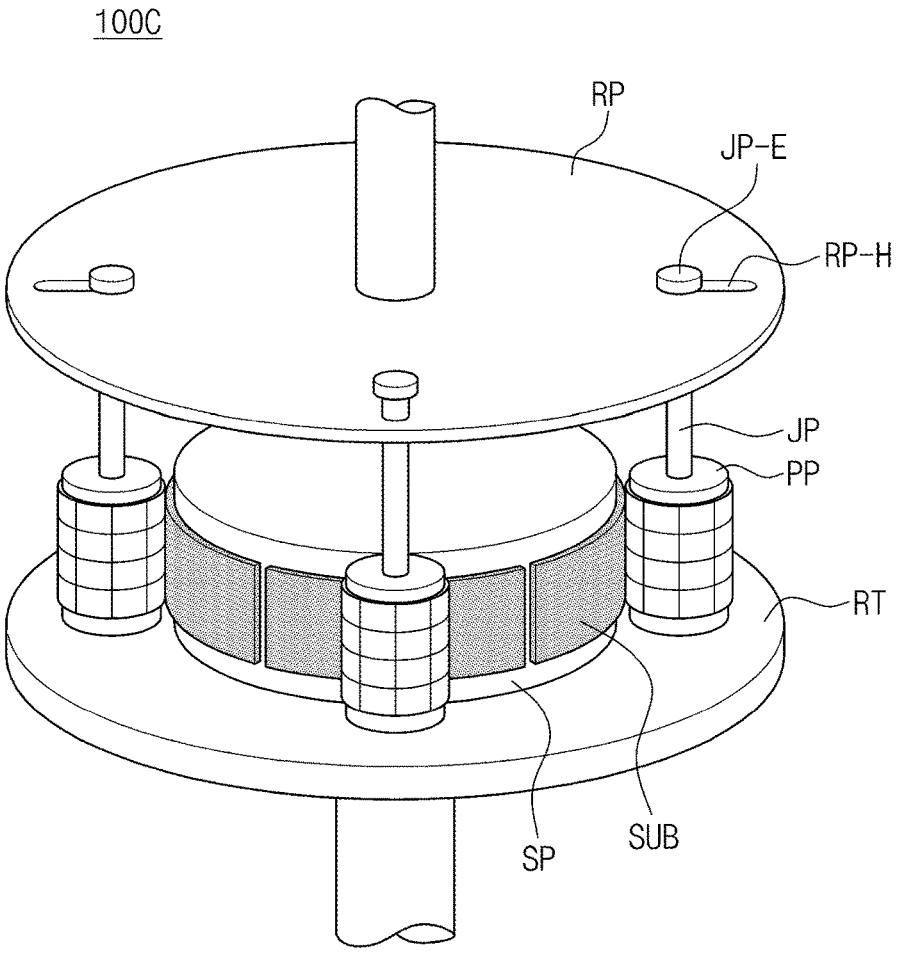
FIG. 7 is a perspective view showing a polishing apparatus according to some exemplary embodiments of the present disclosure.

FIG. 7 is a perspective view showing a polishing apparatus 100C according to some exemplary embodiments of the present disclosure.

In the polishing apparatus 100C shown in FIG. 7, the substrate SUB, having a curved surface, is affixed to the outer circumferential surface SP-O of the substrate supporting part SP. In this embodiment, the placing surface of the substrate SUB corresponds to the outer circumferential surface of the substrate supporting part SP and the process surface of the substrate SUB is exposed to the outside.

In the embodiment in FIG. 7, the substrate supporting part SP has a substantially cylindrical shape. In detail, the substrate supporting part SP has a substantially circular shape in a cross-section perpendicular to a height direction of the substrate supporting part SP (e.g., in a horizontal cross-section of a substantially vertical height direction) and a radius of the circular shape is longer than the height of the substrate supporting part SP. In embodiments where the substrate SUB is affixed to the outer circumferential surface of the substrate supporting part SP, the substrate supporting part SP may have a substantially hollow cylindrical shape.

The polishing part PP in the embodiment in FIG. 7 faces the substrate SUB affixed to the outer circumferential surface SP-O and allows the coupling member JP thereof to be substantially parallel to the process surface of the substrate SUB. In addition, in embodiments where the substrate SUB is affixed to the outer circumferential surface of the substrate supporting part SP, a circumference of the rotating plate RP to which the polishing part PP is affixed may be greater than a circumference of the substrate supporting part SP.

According to the polishing apparatuses shown in FIGS. 1 to 7, the substrate supporting part SP is shaped to allow the curvature of the substrate SUB to correspond to the curvature of the substrate supporting part SP to which the substrate SUB is affixed. Therefore, the polishing part PP may uniformly polish the surface of the substrate SUB along the curved surface of the substrate SUB, and thus uniform polishing quality may be achieved with respect to the curved surface of the substrate SUB.

In addition, since the polishing part PP is substantially parallel to the process surface of the substrate SUB, polishing residue generated during the substrate polishing process may be discharged downward and removed from the process surface of the substrate SUB. Therefore, defects in quality caused by the polishing process may be prevented from occurring.

Figure 8A:
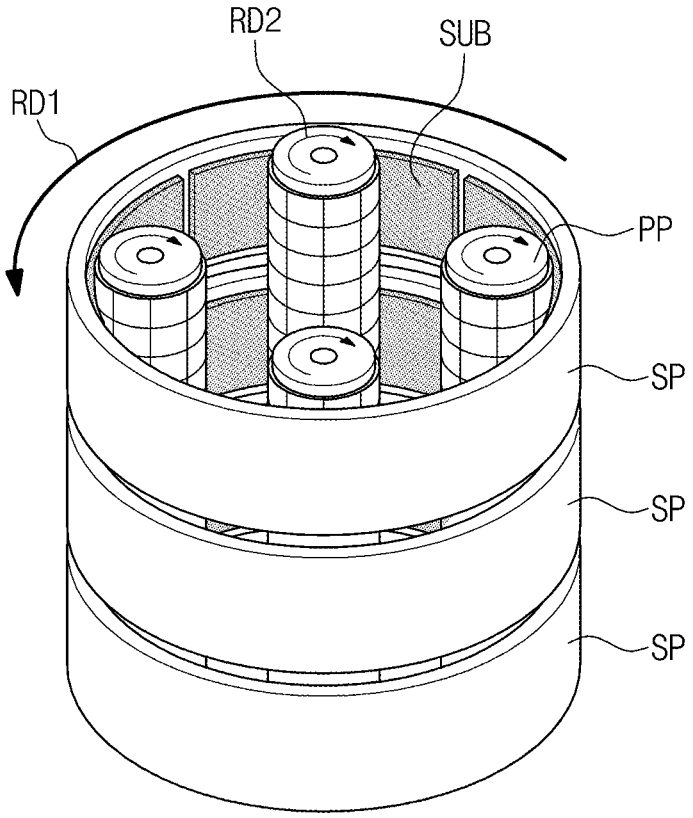
FIGS. 8A and 8B are a perspective view and a cross-sectional view showing an arrangement of the substrate supporting part according to some exemplary embodiments of the present disclosure.
Figure 8B:
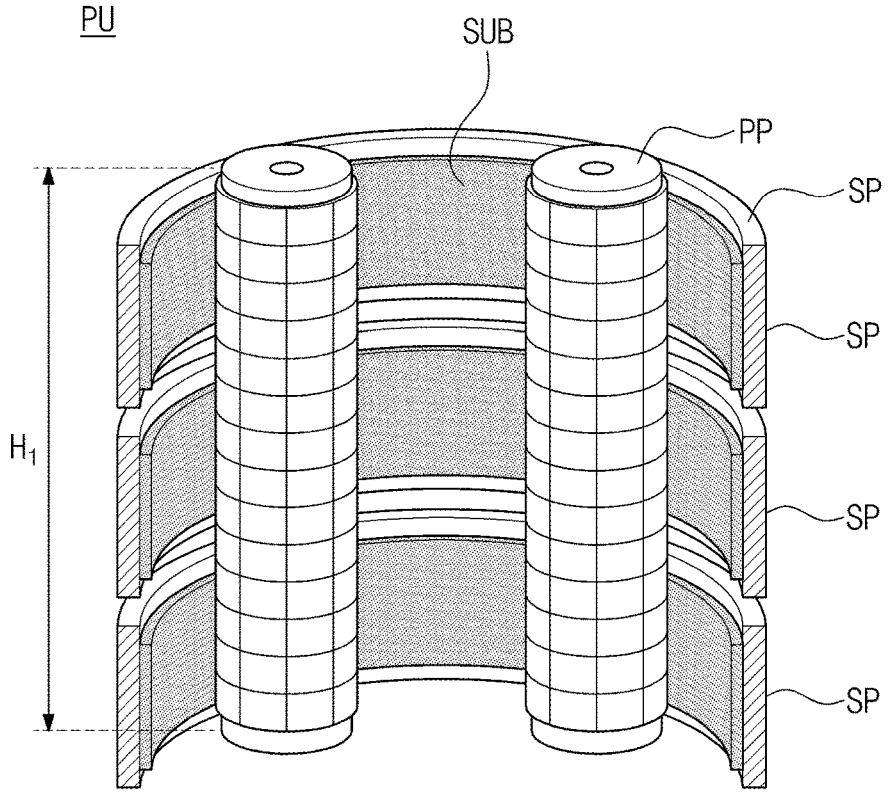

FIGS. 8A and 8B are a perspective view and a cross-sectional view showing an arrangement of the substrate supporting part SP according to some exemplary embodiments of the present disclosure.

Referring to FIGS. 8A and 8B, the jig unit JU may include a plurality of substrate supporting parts SP. The substrate supporting parts SP may be spaced apart from each other or located such that upper and lower surfaces of the substrate supporting parts SP are adjacent to each other. As shown in FIG. 8A, each substrate supporting part SP may have a substantially hollow cylindrical shape without upper and lower surfaces.

In embodiments where the polishing apparatus includes a plurality of substrate supporting parts SP, the polishing part PP of the polishing unit PU may have a height $H_1$ long enough to substantially simultaneously polish the substrates SUB located on the plurality of substrate supporting parts SP. For instance, the height $H_1$ of the polishing part PP may correspond to an overall height of the plurality of substrate supporting parts SP stacked on one another. As shown in FIGS. 8A and 8B, when the plurality of substrate supporting parts SP are stacked on one another, multiple substrates SUB are substantially simultaneously processed, and thus the productivity of the polishing apparatus may be improved and the polishing quality of the surface of the substrates SUB may be uniformly maintained.

Figure 9:
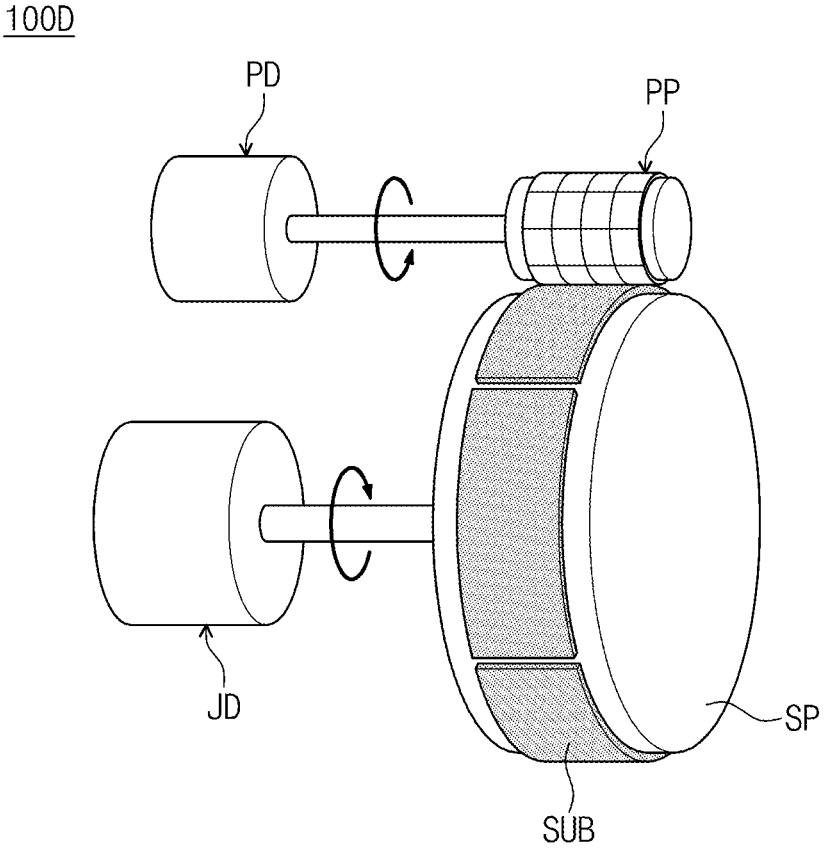
FIG. 9 is a perspective view showing a polishing apparatus according to some exemplary embodiments of the present disclosure.

FIG. 9 is a perspective view showing a polishing apparatus 100D according to some exemplary embodiments of the present disclosure.

Different from the substrate supporting part SP shown in FIG. 2, the substrate supporting part SP may be arranged in a vertical direction as shown in FIG. 9. In this embodiment, the jig driving part JD may be disposed in a left or right side with respect to the substrate supporting part SP.

In addition, as shown in FIG. 9, the polishing driving part PD may be located on a left or right side with respect to the polishing part PP. For instance, in embodiments where there is limited space to install the polishing apparatus 100D, the substrate supporting part SP may be arranged in a vertical direction as shown in FIG. 9.

Figure 10:
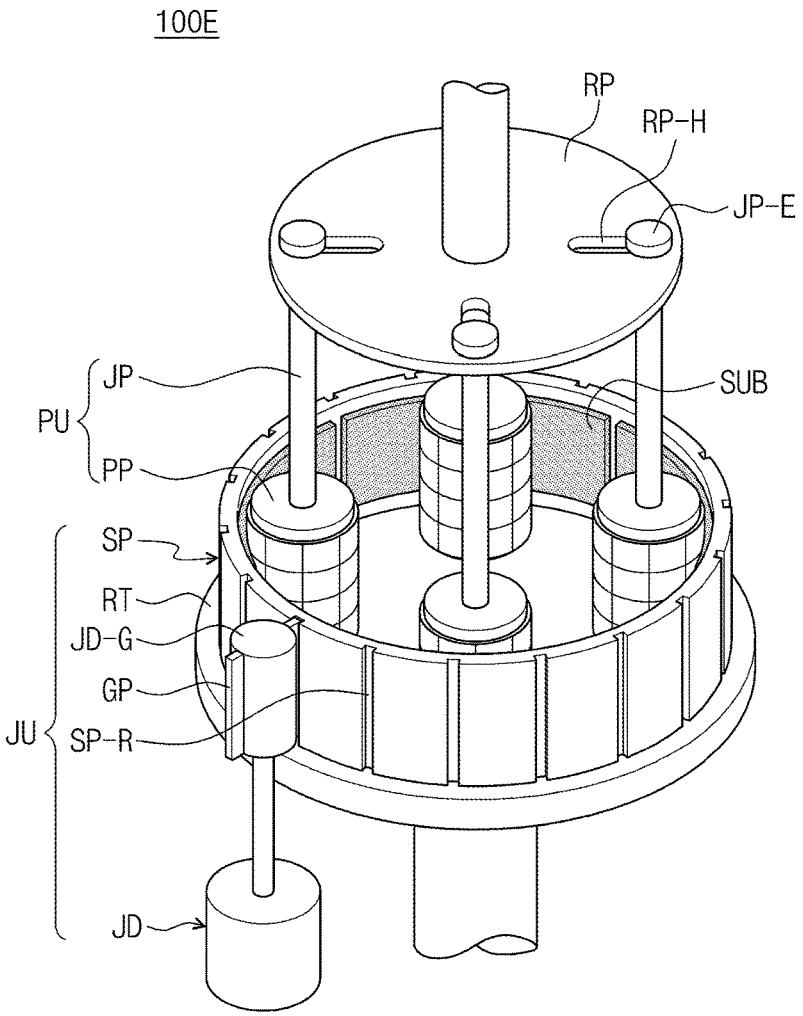
FIG. 10 is a perspective view showing a polishing apparatus according to some exemplary embodiments of the present disclosure.

FIG. 10 is a perspective view showing a polishing apparatus 100E according to some exemplary embodiments of the present disclosure.

Referring to FIG. 10, the polishing apparatus 100E includes a polishing unit PU and a jig unit JU. The jig unit JU further includes a driving part JD and the driving part JD may include a driving gear JD-G. In this embodiment, the driving part JD may be a jig driving part (e.g., to apply power to rotate rotating table RT).

The polishing apparatus 100E includes a substrate supporting part SP to which the substrate SUB is affixed, and the substrate supporting part SP may include a plurality of recesses SP-R formed in an inner circumferential surface SP-I or outer circumferential surface SP-O and arranged at regular intervals. For instance, the substrate SUB may be placed on the inner circumferential surface SP-I of the substrate supporting part SP and the recesses SP-R may be formed in the outer circumferential surface SP-O of the substrate supporting part SP.

In addition, the driving gear JD-G may include a plurality of protrusions GP and the protrusions GP may be respectively inserted into the recesses SP-R formed in the substrate supporting part SP. In this embodiment, the jig driving part JD having the driving gear JD-G may be located inside or outside of the substrate supporting part SP in accordance with the positions of the recesses SP-R formed in the substrate supporting part SP.

The substrate supporting part SP may be rotated by the jig driving part JD including the driving gear JD-G. That is, the protrusions GP formed on the driving gear JD-G are sequentially inserted into the recesses SP-R of the substrate supporting part SP while the driving gear JD-G is rotated, and thus the substrate supporting part SP is rotated.

In the present exemplary embodiment of FIG. 10, the polishing unit PU may further include a separate polishing driving part PD (not shown). Thus, due to the operation of the driving gear JD-G, the substrate supporting part SP may be rotated and the polishing part may be fixed to polish the surface of the substrate SUB. In addition, the substrate supporting part and the polishing part may be simultaneously rotated to polish the surface of the substrate SUB.

Figure 11A:
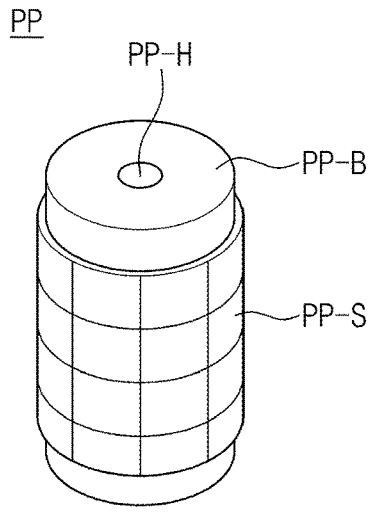
FIG. 11A is a perspective view showing a polishing part according to some exemplary embodiments of the present disclosure.

FIG. 11A is a perspective view showing a polishing part PP according to some exemplary embodiments of the present disclosure.

Referring to FIG. 11A, the polishing part PP includes a body PP-B and a polishing layer PP-S surrounding the body PP-B. The body PP-B may include a metal material to maintain the shape of the polishing part PP, but is not limited thereto or thereby. The body PP-B may include a hole PP-H formed through a center portion of the body PP-B, to which the coupling member may be inserted. In addition, the polishing layer PP-S surrounding the body PP-B of the polishing part PP may have a predetermined thickness.

For instance, the polishing layer PP-S may be, but not limited to, a polishing sheet, a polishing pad, a brush, or a sponge. In addition, the polishing sheet or the polishing pad may be formed by molding a resin layer including polishing particles. The material for the polishing layer PP-S may be selected in accordance with the polishing degree required for the process surface of the substrate SUB.

Figure 11B:
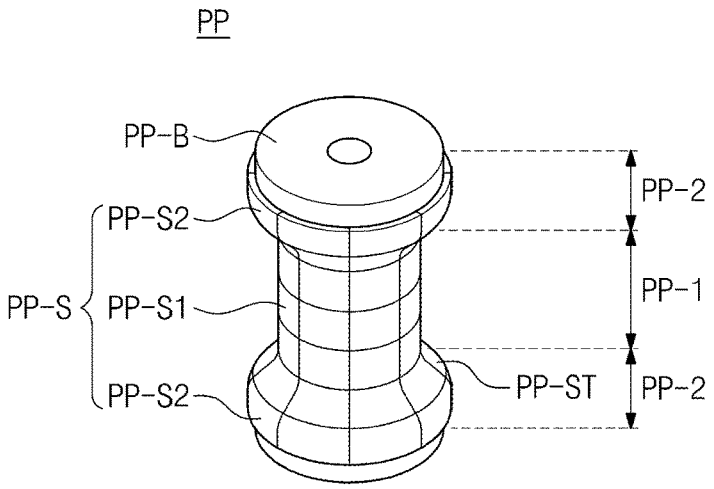
FIG. 11B is a perspective view showing a polishing part according to some exemplary embodiments of the present disclosure.
Figure 11C:
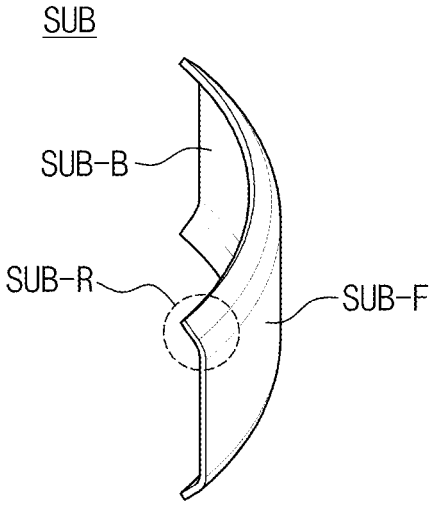
FIG. 11C is a view showing a substrate polished by the polishing part shown in FIG. 11B according to some exemplary embodiments of the present disclosure.

FIG. 11B is a perspective view showing a polishing part PP according to some exemplary embodiments of the present disclosure and FIG. 11C is a view showing a substrate SUB polished by the polishing part PP shown in FIG. 11B according to some exemplary embodiments of the present disclosure.

Referring to FIG. 11B, the polishing part PP includes a body PP-B and a polishing layer PP-S surrounding the body PP-B. In addition, the polishing part PP has a substantially cylindrical shape and includes a first sub-polishing part PP-1 at a center portion of the polishing part PP and a second sub-polishing part PP-2 extending from the first sub-polishing part PP-1 and having a stepped portion PP-ST. The second sub-polishing part PP-2 may be adjacent an upper portion and/or a lower portion of the first sub-polishing part PP-1.

The second sub-polishing part PP-2 may have a circumference greater than that of the first sub-polishing part PP-1. In addition, the stepped portion PP-ST of the second sub-polishing part PP-2 may have a variable shape that is changed in accordance with the shape of the substrate SUB. For instance, in embodiments where an edge of the substrate SUB has a curvature SUB-R as shown in FIG. 11C, the second sub-polishing part PP-2 of the polishing part PP may have a stepped portion PP-ST corresponding to the curvature SUB-R of the edge of the substrate SUB.

The polishing layer PP-S surrounds the body PP-B in the first and second sub-polishing parts PP-1 and PP-2. In addition, the polishing layer PP-S may be located on the second sub-polishing part PP-2 to allow a portion of the body PP-B to be exposed.

The polishing layer PP-S may include a first polishing layer PP-S1 in the first sub-polishing part PP-1 and a second polishing layer PP-S2 in the second sub-polishing part PP-2. The first and second polishing layers PP-S1 and PP-S2 may be made of the same materials, but are not limited thereto or thereby. For instance, the first and second polishing layers PP-S1 and PP-S2 may have different surface roughnesses from each other in accordance with the shape of the substrate.

In some embodiments, the polishing apparatus may include a separate polishing liquid supply part. The polishing liquid may include a material containing polishing particles and may be used to allow the polishing process to be smoothly carried out. The polishing liquid may be provided to a space between the polishing part PP and the substrate SUB.

The polishing apparatus may be used to process the surface of the substrate SUB having a curvature, and thus the polishing quality of the surface of the substrate SUB may be improved. In particular, the substrate supporting part SP, to which the substrate SUB having the curvature is affixed, may be shaped to have a curvature corresponding to the curvature of the substrate SUB. Accordingly, the polishing part PP may be rotated to correspond to the curved shape of the substrate SUB, and thus the surface of the substrate SUB may be uniformly polished. Therefore, uniform polishing quality may be achieved with respect to the curved surface of the substrate SUB.

In addition, since multiple substrates SUB having the same curvature may be affixed to the substrate supporting part SP, the surfaces of the substrates SUB may be substantially simultaneously processed and the productivity of the polishing apparatus may be improved. Further, since the process surface of the substrate SUB is substantially parallel to the polishing part, foreign substances, e.g., polishing residues, generated during the substrate polishing process may be discharged downward and removed from the process surface of the substrate SUB. As a result, defects in quality, which are caused by the polishing process, may be prevented from occurring.

Although exemplary embodiments of the present invention have been described, it is understood that the present invention is not limited to these exemplary embodiments and various changes and modifications can be made by one ordinary skilled in the art within the spirit and scope of the present invention as hereinafter claimed.

The above description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure.

What is claimed is:

1. A polishing apparatus comprising:

a jig unit comprising a substrate supporting part, the substrate supporting part comprising a placing surface on which a substrate having a first curvature is configured to be placed, wherein the placing surface has a second curvature corresponding to the first curvature; and a polishing unit comprising at least one polishing part configured to be rotated to polish a process surface of the substrate; a rotating plate located above the at least one polishing part and holding the at least one polishing part; and a coupling member connecting a polishing part of the at least one polishing part and the rotating plate.

2. The polishing apparatus of claim 1, wherein the first curvature is substantially equal to the second curvature.

3. The polishing apparatus of claim 1, wherein the jig unit further comprises:

a rotating table on which the substrate supporting part is arranged; and a jig driving part configured to rotate the rotating table.

4. The polishing apparatus of claim 1, wherein the polishing unit further comprises a polishing driving part to rotate the polishing part.

5. The polishing apparatus of claim 1, wherein the coupling member defines a rotating axis to rotate the polishing part.

6. The polishing apparatus of claim 5, wherein the coupling member is substantially parallel to the process surface of the substrate.

7. The polishing apparatus of claim 1, wherein the substrate supporting part comprises a plurality of vacuum suction inlets to hold the substrate.

8. A polishing apparatus comprising:

a jig unit comprising a substrate supporting part, the substrate supporting part comprising a placing surface on which a substrate having a first curvature is configured to be placed, wherein the placing surface has a second curvature corresponding to the first curvature; and a polishing unit comprising at least one polishing part configured to be rotated to polish a process surface of the substrate, wherein the substrate supporting part has a substantially cylindrical shape having a radius corresponding to the second curvature and an empty space defined therein.

9. The polishing apparatus of claim 1, wherein the substrate supporting part has a substantially cylindrical shape having a radius corresponding to the second curvature and the radius is greater than a height of the cylindrical shape.

10. The polishing apparatus of claim 1, wherein the substrate supporting part is configured to be rotated in a first direction and the polishing part is configured to be rotated in a direction opposite to the first direction.

11. The polishing apparatus of claim 1, further comprising a driving part to rotate the jig unit, wherein the substrate supporting part comprises a plurality of recesses formed in one of an inner circumferential surface and an outer circumferential surface of the substrate supporting part and arranged at regular intervals, and the driving part comprises a driving gear comprising a plurality of protrusions configured to be respectively inserted into the recesses.

12. The polishing apparatus of claim 1, wherein the substrate supporting part comprises a plurality of substrate supporting parts stacked on one another.

13. The polishing apparatus of claim 1, wherein the polishing part comprises:

a body having a cylindrical shape; and a polishing layer on an outer circumferential surface of the body.

14. The polishing apparatus of claim 13, wherein the polishing layer is at least one of a polishing sheet, a polishing pad, a brush, or a sponge.

15. A polishing apparatus comprising:

a jig unit comprising a substrate supporting part, the substrate supporting part comprising a placing surface on which a substrate having a first curvature is configured to be placed, wherein the placing surface has a second curvature corresponding to the first curvature; and a polishing unit comprising at least one polishing part configured to be rotated to polish a process surface of the substrate, wherein the polishing part comprises:

a first sub-polishing part having a substantially cylindrical shape and located at a center portion of the polishing part; and a second sub-polishing part extending from the first sub-polishing part and comprising a stepped portion, and wherein the second sub-polishing part has a circumference greater than a circumference of the first sub-polishing part.

16. The polishing apparatus of claim 15, wherein the second sub-polishing part is adjacent at least one of an upper portion and a lower portion of the first sub-polishing part.

17. The polishing apparatus of claim 15, wherein the polishing layer comprises a first polishing layer in the first sub-polishing part and a second polishing layer in the second sub-polishing part and wherein the first polishing layer and second polishing layer have different surface roughnesses.

18. The polishing apparatus of claim 1, wherein the coupling member is offset in a radial direction from an axis of rotation of the rotating plate.

19. The polishing apparatus of claim 1, wherein the coupling member is movable along a radial direction relative to the rotating plate.

* * * * *